US005887341A

United States Patent [19]

Ito et al.

[11] Patent Number: 5,887,341

[45] Date of Patent: Mar. 30, 1999

[54] BLOCK AND RETAINER FOR WIRE-CONNECTED TERMINALS AND WIRE CONNECTION PROCESS LINE USING THE SAME

[75] Inventors: Hideaki Ito; Kouichi Ueda; Teiji Sakuma; Kazumitsu Fukada; Yasutoshi Takemoto, all of Yokkaichi; Shigeru Kato, Itami; Masakazu Kashiwase, Itami; Masaaki Fujii, Itami; Toshiyuki Kuramoto, Itami, all of Japan

[73] Assignee: Sumitomo Wiring Systems, Ltd., Japan

[21] Appl. No.: 747,909

[22] Filed: Nov. 12, 1996

[30] Foreign Application Priority Data

Nov. 24, 1995 [JP] Japan ..... 7-306146
Jan. 29, 1996 [JP] Japan ..... 8-013301

[51] Int. Cl.[6] ..... H01R 43/00

[52] U.S. Cl. ..... 29/760; 29/33 M; 29/759

[58] Field of Search ..... 29/747, 748, 755, 29/759, 760, 844, 881, 741, 33 M

[56] References Cited

U.S. PATENT DOCUMENTS 5,465,479 11/1995 Bowen et al. ..... 29/760 X
5,477,607 12/1995 Ohta et al. ..... 29/748
5,606,795 3/1997 Ohba et al. ..... 29/760 X
5,740,604 4/1998 Kitamura et al. ..... 29/741 X

FOREIGN PATENT DOCUMENTS 0 277 279 8/1988 European Pat. Off. .
0 286 208 10/1988 European Pat. Off. .
57-170409 of 1982 Japan .
5-234659 of 1993 Japan .
6-223646 of 1994 Japan .
08064333 3/1996 Japan .

*Primary Examiner*—Peter Vo
*Assistant Examiner*—Rick Kiltae Chang
*Attorney, Agent, or Firm*—Anthony J. Casella; Gerald E. Hespos; Ludomir A. Budzyn

[57] ABSTRACT

To position a wire-connected terminal TW and cope with a multitude of kinds of wire-connected terminals TW, a block 30 is provided for each wire-connected terminal TW. The block 30 includes recesses 34, 37 for detachably accommodating the wire-connected terminal TW. A part of the accommodated wire-connected terminal TW is exposed such that it can be gripped by hands 51, 52. The block 30 also includes a positioning means 38 for positioning the terminal TW accommodated in the recesses 34, 37 with respect to the hands 51, 52. Since the terminal TW is securely positioned in a transferring step of transferring the wire-connected terminal TW to the hands 51, 52, the succeeding step performed by the hands 51, 52 can be securely performed.

13 Claims, 13 Drawing Sheets

BLOCK AND RETAINER FOR WIRE-CONNECTED TERMINALS AND WIRE CONNECTION PROCESS LINE USING THE SAME

BACKGROUND OF THE INVENTION

1. Field of the Invention

The present invention relates to a block and a retainer for wire-connected terminals, and to a wire connection process line using the block and retainer. The retainer accommodates a terminal-connected wire which is juxtaposed with a terminal inserting unit that automatically inserts terminals mounted on wires into a connector housing to form a wiring harness for an automotive vehicle or for a copier.

2. Description of the Prior Art

The prior art includes processes for automatically manufacturing a wire assembly, such as a wiring harness for an automotive vehicle, a copier or the like. The prior art process for automatically manufacturing a wiring harness includes steps for producing a terminal-connected wire. These prior art process steps include cutting a wire to a predetermined length, peeling the insulation coating at the opposite ends of the cut wire, connecting terminals to the peeled ends of the wire and inserting the terminals of the terminal-connected wires into a connector housing. Prior art systems that perform these steps along a single production line are disclosed, for example in Japanese Unexamined Patent Publications Nos. 57-170409, 58-25014, 5-234659 and 6-260260. The connecting process for inserting the terminals of the wire-connected terminals into connector housings requires a long time as compared with the producing process for producing the wire-connected terminals. Accordingly, the production efficiency of wiring harnesses is disadvantageously restricted in the prior art systems where the producing process and the connecting process are performed on a single production line.

The prior art also includes wire harness producing systems in which the producing process and the connecting process are performed at separate lines. This prior art process includes a transfer step in which wires with terminals mounted thereto are gripped and transferred to hands or clamps of a terminal inserting unit.

An example of a prior art system that uses separate lines for the producing process and the connecting process is disclosed in Japanese Unexamined Patent Publication No. 6-223646. This prior art system enables the mounting of special terminals to wires, such as the mounting of specially sized terminals or the connection of a plurality of wires with the same terminal. The prior art system shown in Japanese Unexamined Patent Publication No. 6-223646 requires two separate terminal mounting lines: one for mounting standardized terminals and the other for mounting special terminals. This prior art system then performs a transferring step in which the wire-connected terminals are temporarily placed on a stock carriage, and subsequently are manually transferred to an inserting station upstream of the terminal mounting line. FIGS. 7 and 13 of Japanese Unexamined Publication No. 6-223646 show the inserting station for performing the transferring step. As part of this transferring step, the opposite ends of the wires are manually placed on a wire setting table, gripped by a pair of hands or clamps, and forcibly inserted into teeth of a comb-like wire grip.

The above described prior art transferring step requires precise positioning of the terminal portions of the wire-connected terminals with respect to the hands or clamps in order to securely perform a succeeding step by the hands (e.g. a step of inserting the terminal portions of the wire-connected terminals into a connector). However, the wire setting table of the aforementioned prior art is mainly adapted to transfer the wires to the hands when the wires are forcibly inserted into the teeth of the comb-like wire grip and, therefore, cannot position the terminal portions. Further, it is a common practice to process a plurality of kinds of terminals at one production line in order to manufacture a wire assembly. Thus there is a desire to produce many kinds of wire-connected terminals in small quantity by easily changing the kind and the combination of kinds of wire-connected terminals partly locked during the transferring step.

Prior art wire harness producing systems in which the producing process and the connecting process are performed at separate lines, are not well suited to automation because it is difficult to transfer the terminals of the terminal-connected wires to the terminal inserting unit while manually positioning them. Therefore, it is necessary to make an undesirable compromise of manually inserting the terminals into the connector housing as disclosed in Japanese Unexamined Patent Publication No. 6-223646.

In view of the above problems, an object of the invention is to provide a block and a retainer for wire and/or terminals, in particular wire-connected terminals, using the same and a wire connection process line using the same, which are capable of easily positioning the wire and/or terminals, in particular wire-connected terminals, to be retained and changing the kinds thereof.

SUMMARY OF THE INVENTION

According to the invention there is provided a block for retaining a wire-connected terminal in which an end of a wire is connected with a terminal. The block comprises at least one recess for detachably accommodating at least a terminal portion and/or a wire portion of the wire-connected terminal. The block further comprises positioning means for positioning the terminal portion and/or the wire portion accommodated in the recess.

According to a preferred embodiment of the invention, a part of the wire-connected terminal is exposed in the recess of the block such that it can be gripped by hands or clamping means of a separately provided terminal inserting unit.

Preferably, the block further comprises a slit for permitting lateral insertion of the terminal and/or terminal portion and/or wire portion into the recess by permitting the insertion of the terminal-connected wire or wire-connected terminal or at least the wire section adjacent to the terminal portion and/or of the wire portion.

Further preferably, the positioning means positions the terminal portion along the vertical direction or substantially along a direction of the longitudinal axis of the terminal portion and/or wire portion. The positioning means may comprise a pin insertable into an engaging or contact hole of the terminal portion and/or of the wire portion. The positioning means may comprise a positioning surface for positioning the bottom surface of the terminal portion and/or for positioning of a rubber plug integrally or unitarily connected or mounted on the terminal portion and/or of the wire portion.

Most preferably, the positioning means positions the terminal portion and/or the wire portion along the forward and backward directions or along a direction substantially normal to the longitudinal axis of the terminal portion and/or wire portion. In particular the positioning means may comprise a positioning surface for coming into contact with a rear surface of the terminal portion and/or wire portion accommodated in the recess to position the terminal portion and/or wire portion.

According to a further preferred embodiment, the recess of the block comprises at least one rotation restricting surface for restricting the terminal of the accommodated terminal-connected wire or wire-connected terminal so as not to rotate around its longitudinal axis.

Preferably, the rotation restricting surface is defined by a piece formed by a member separate from the block, wherein preferably the rotation restricting surface comprises a pair of side surfaces for holding the terminal substantially from opposite sides. The piece forming the rotation restriction surface may define an aperture for substantially exposing a front surface of the terminal.

Still further preferably, the piece defines at least one insertion opening in the front surface of the terminal which substantially is necessary and sufficient to permit the insertion of the wire, in particular of the wire section adjacent to the terminal portion and/or of the wire portion.

Each block may comprise a single member or portion or section for retaining a single wire-connected terminal or a plurality of integrally or unitarily connected members for retaining a plurality of wire-connected terminals.

According to the invention there is further provided a retainer for a wire-connected terminal, comprising: one or more blocks according to the invention, and a frame for selectively arranging the blocks, so as to arrange one or more wire-connected terminals, in particular side by side. The blocks may be of one or more kinds for arranging one or more different kinds of wire-connected terminals. Additionally the blocks may be integrally or unitarily connected.

Preferably, the respective blocks are arranged such that the center axes of the respective wire-connected terminals are substantially aligned at specified intervals, regardless of the kinds of the terminals to be positioned by the blocks.

As an alternate to the above construction with a frame and a plurality of blocks, the invention may comprise a single block including a plurality of sets of recesses, positioning surfaces and slits. Each recess is for accommodating the corresponding terminal-connected wire while being opened such that it can grip a part of the terminal. Each positioning surface is continuous with the corresponding recess, and is adapted to position the bottom surface of the terminal accommodated in the recess. Each slit for permitting the insertion and withdrawal of the terminal into and from the recess by permitting the terminal-connected wire to pass therethrough. Thus there is provided a retainer for a terminal-connected wire which facilitates the automation of a connecting process.

In this latter construction, the recesses for accommodating the terminals of the terminal-connected wires are opened such that they can grip parts of the terminals, and the slits for permitting the insertion and withdrawal of the terminal-connected wires into and from the recesses are provided. Accordingly, the terminal-connected wires can be manually detachably set in the block. Further, since the bottom surfaces of the terminals are positioned by the positioning surfaces, it is possible to position the accommodated terminals and to grip them by insertion hands.

According to the invention there is still further provided a wire connection process line for producing and/or processing wire-connected terminals, in particular for inserting the wire-connected terminals into a connector housing. The processing line may comprise at least one block according to the invention and/or at least one retainer according to the invention. The block may be at an upstream end of the wire connection process line. The processing line may further include insertion clamps for inserting the terminals into a connector housing.

According to a preferred embodiment of the invention, the wire connection process line is separated from a manufacturing process line. The manufacturing process line is operative for cutting and/or peeling a wire and/or mounting a terminal on the wire, and is adapted to supply the wire-connected terminals to be transferred to the insertion clamps of the wire-connecting process line.

Accordingly a synchronization of the wire-connection process line and of the manufacturing process line is made possible, even though the latter has a higher processing speed than the former. Thus a complete automatization is advantageously possible.

Preferably, the block and/or the retainer is detachably secured by mount means to a conveyance means, comprising, in particular, a conveyance disk and/or conveyance line for conveying wire-connected terminals to insertion clamps of an inserting unit.

These and other objects, features and advantages of the present invention will become more apparent upon a reading of the following detailed description and accompanying drawings.

BRIEF DESCRIPTION OF THE DRAWINGS

FIGS. 6A and 6B show another embodiment of the invention, wherein FIG. 6A is a section of this embodiment when a normal wire-connected terminal is retained and FIG. 6B is a section thereof when a wire-connected terminal having a portion between a terminal portion and a wire portion sealed by a rubber plug is positioned.

DETAILED DESCRIPTION OF THE PREFERRED EMBODIMENTS

Figure 1:
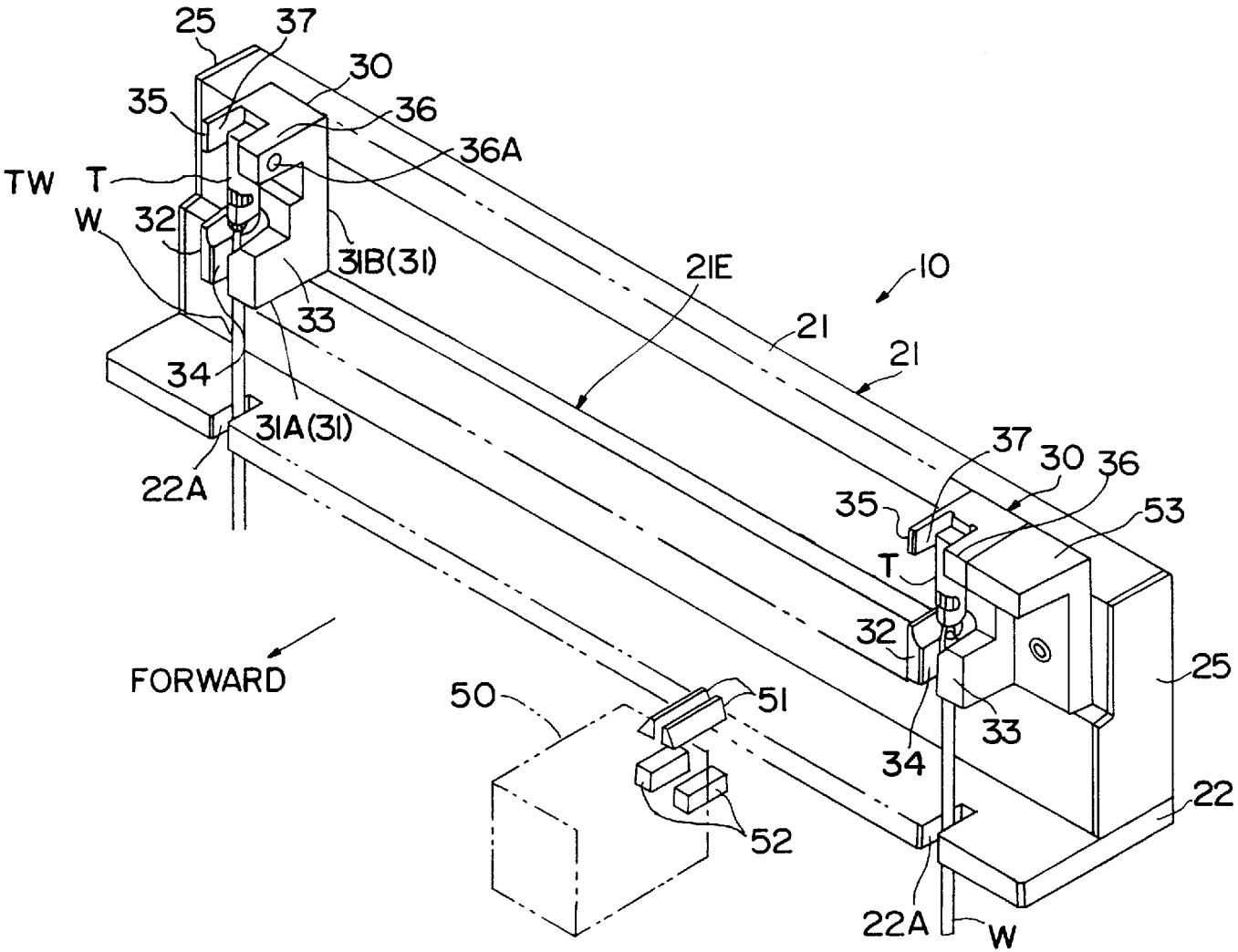
FIG. 1 is a perspective view showing the schematic construction of a retainer for wire-connected terminals according to one embodiment of the invention.

FIG. 1 is a perspective view showing the schematic construction of a retainer 10 for wire-connected terminals according to one embodiment of the invention. With reference to FIG. 1, the retainer 10 includes a mount frame 20 detachably secured to a terminal hand or gripper or clamp 51 of an inserting unit 50 for inserting a wire-connected terminal TW into a connector housing (not shown) and to a supply apparatus (not shown) for supplying the wire-connected terminal TW to a wire hand or gripper or clamp 52. The retainer 10 also includes a plurality of blocks 30 detachably arranged side by side on the mount frame 20.

Figure 4A:
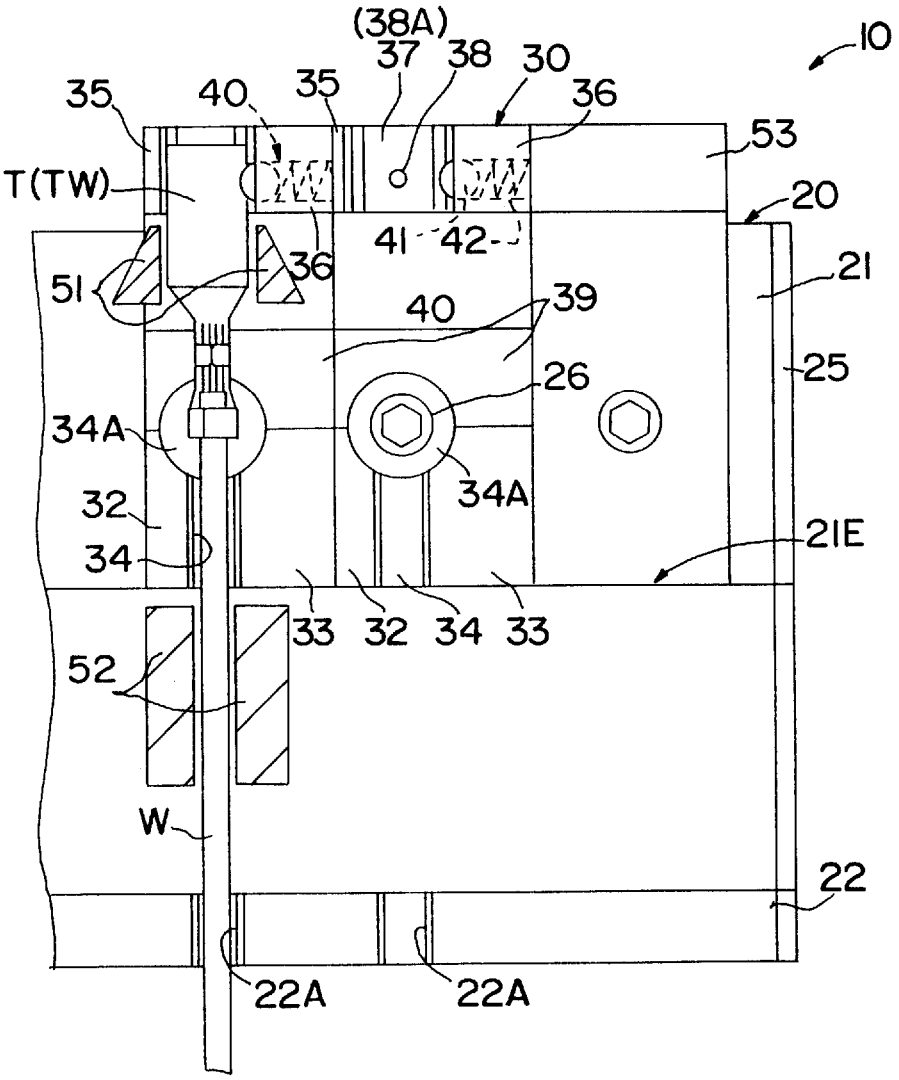
FIG. 4(A) is a partial diagram of an essential portion of the retainer of FIG. 1.
Figure 4B:
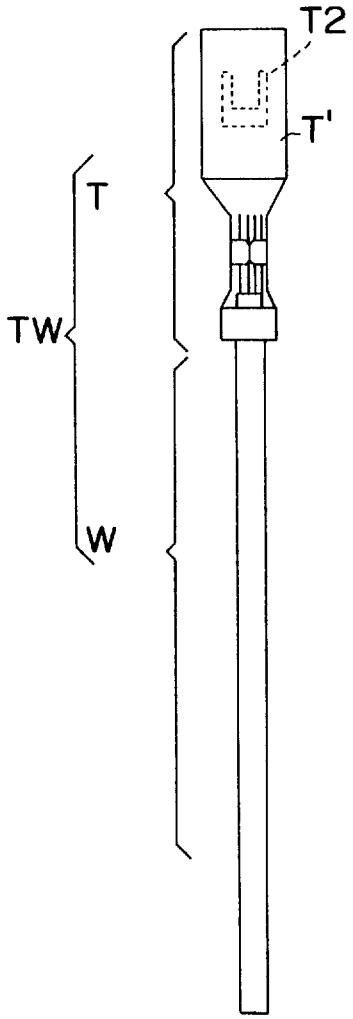
FIG. 4(B) is a schematic diagram showing an exemplary wire-connected terminal TW.

The wire-connected, terminal TW, as shown e.g. in FIG. 4(B), is of a known type, and includes a terminal T' mounted or provided at a peeled end of an insulated wire. The wire-connected terminal TW includes a terminal portion T and a wire portion W. The terminal portion T comprises the terminal T' and a section of a wire end that has been substantially peeled. The wire portion W includes a portion of the wire neighboring or adjacent to the terminal T'. Preferably the terminal T' comprises (FIG. 4(B)) an engaging or contact hole or recess T2 to be described later.

Figure 2:
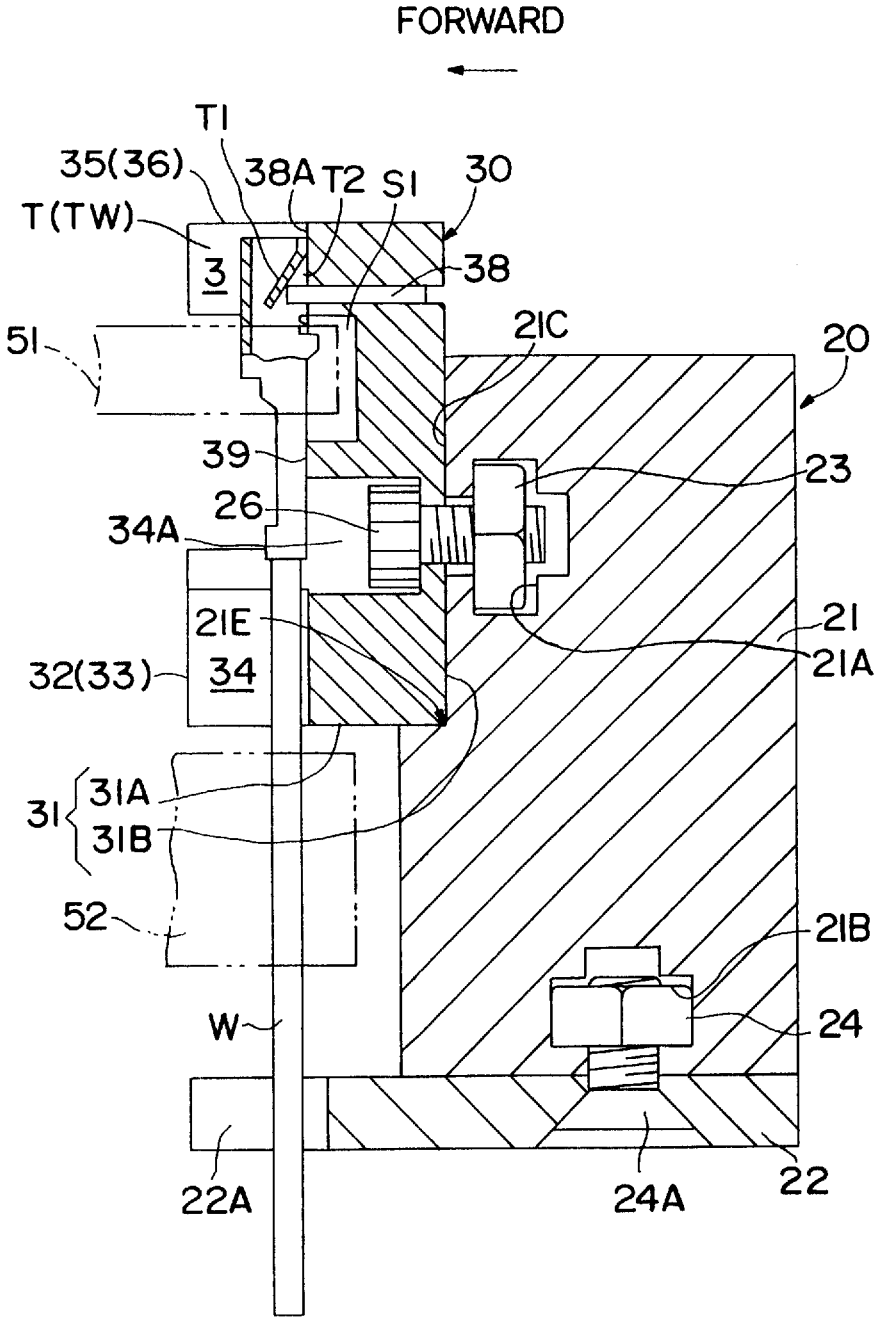
FIG. 2 is a section of the retainer of FIG. 1.

With reference to FIGS. 1 and 2, the mount frame 20 includes a main body 21 having a substantially rectangular parallelepipedic shape and a guide member 22 secured to the main body 21. The main body 21 is made of, e.g., aluminum alloy and is formed with a first groove 21A for immovably accommodating a nut 23 for fastening the block 30 and a second groove 21B for immovably accommodating a nut 24 for securing the guide member 22. The grooves 21A, 21B extend substantially in parallel with the longitudinal direction of the main body 21, communicating one end of the main body 21 with the other end thereof. Normally, the grooves 21A, 21B are selectively closed by a cover member 25 (see FIG. 1). The first groove 21A accommodates the nut 23 such that the center axis of the nut 23 is substantially normal to a surface 21C for fastening the block 30 (hereafter, this surface is assumed to be a front surface), whereas the second groove 21B accommodates the nut 24 such that the center axis of the nut 24 is substantially normal to the bottom surface of the main body 21.

A stepped portion 21E for aligning the blocks 30 is formed on the front surface 21C of the main body 21. The blocks 30 are arranged along the longitudinal direction of the main body 21 while being seated on the stepped portion 21E, and are detachably secured by bolts 26 formed with hexagonal holes which threadedly engage the nuts 23.

The guide member 22 is a plate-like member secured to the bottom surface of the main body 21 by bolts 24A to which the nuts 24 are spirally fitted. At the front of the guide member 22, there are formed tooth-shaped guide grooves 22A so as to correspond to the blocks 30 to be described later. The guide grooves 22A extend forward from the main body 21, and guide the wire portions W of the wire-connected terminal TW to be accommodated in the respective blocks 30.

With reference to FIGS. 1 to 5, the blocks 30 are metal members made of e.g. aluminum alloy, and hold the wire-connected terminals TW in alignment by being arranged side by side on the stepped portion 21E of the mount frame 20. The blocks 30 to be arranged here may accommodate the same kind of wire-connected terminals TW or different kinds of wire-connected terminals TW. Such a combination is easily realizable by preparing a plurality of kinds of blocks 30 having the same outer dimension L1 and formed with accommodation recesses 37 for accommodating the terminal portions T which recesses have different shapes in conformity with the shapes of the desired wire-connected terminals such that the center axes C of the wire-connected terminals TW to be positioned (terminal pitch) are at specified intervals H.

The block 30 has a seating surface 31 to be seated on the stepped portion 21E formed on the main body 21 of the mount frame 20. The seating surface 31 includes a bottom surface portion 31A to be placed on the bottom surface of the stepped portion 21E and a rear surface portion 31B joined with the front surface 21C of the main body 21.

Where the bottom surface portion 31A is formed, there are a pair of first substantially rectangular projections 32, 33 extending forward and facing each other in the transverse direction (in FIG. 4(A)). A guide groove 34 for guiding the wire portion W of the wire-connected terminal TW is defined between the projections 32, 33. On the other hand, where the rear surface portion 31B is formed, there are a pair of second projections 35, 36 extending forward. The recess 37 for accommodating the terminal portion T of the wire-connected terminal TW is defined between the projections 35 and 36. Between the first projection pair 32, 33 and the second projection pair 35, 36, there is defined an open space S1 for exposing the terminal portion T for the terminal clamp 51 of the inserting unit 50.

Above the pair of first projections 32, 33, there is formed a stepped hole 34A through which a threaded rod of the bolt 26 is inserted until a head thereof comes into engagement with the stepped portion. The block 30 is detachably secured to the mount frame 20 by threadedly fitting the bolt 26 to the nut 23 accommodated in the main body 21 of the mount frame 20.

The second projections 35, 36 are spaced apart by a distance L at least sufficient to mount and detach the wire-connected terminal TW along the forward and backward directions. Thus, the wire-connected terminals TW are immovably accommodated in the recess 37, i.e. are held in the same position. Further, as shown in FIG. 2, where the bottom of the recess 37 is formed, there is provided a pin 38 as a positioning means along the vertical direction which projects forward into the recess 37. The pin 38 is inserted into a contact or engaging hole T2 opened when a contact or engaging member T1 of the terminal portion T is formed, with the result that the terminal TW is accurately positioned along the vertical direction. A surface 38A on which the pin 38 is provided acts to position the terminal portion T along the forward and backward directions.

Between the first projection pair 32, 33 and the second projection pair 35, 36, there is formed a positioning surface 39 projecting forward so as to be flush with the surface 38A. The positioning surface 39 is also designed to position the rear surface of the terminal portion T of the wire-connected terminal TW.

Figure 3:
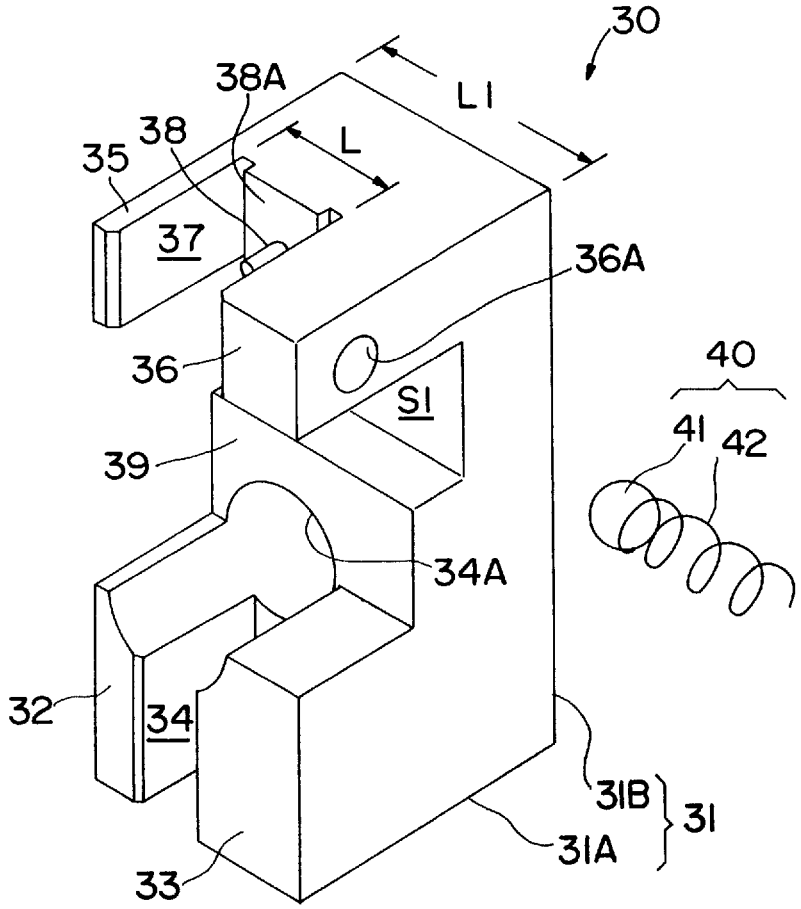
FIG. 3 is a perspective view of a block adopted in the retainer of FIG. 1.
Figure 5:
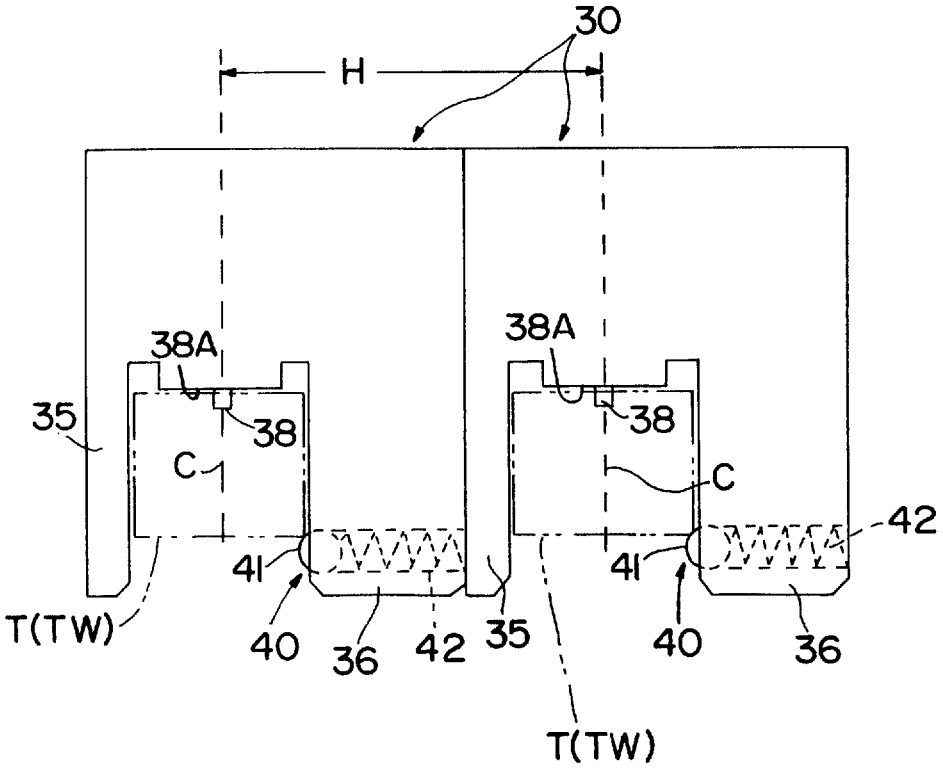
FIG. 5 is a plan view of the block adopted in the retainer of FIG. 1.

As shown in FIGS. 3 to 5, an accommodation hole 36A is formed in one of the second projections 35, 36 (in the projection 36 in the shown example) in order to prevent the terminal portion T of the wire-connected terminal TW accommodated in the recess 37 from coming out, and a ball plunger 40 including a ball 41 and a compression coil spring 42 is accommodated in the hole 36A (see FIGS. 3 and 4(A)). The ball plunger 40 is confined in the hole 36A by the wall surface of the block 30 (i.e. the projection 35) abutting against the projection 36. In order to prevent the ball plunger 40 from disengaging from the projection 36 of the last one of the arranged blocks 30, a sealing positioning member 53 is, similar to the blocks 30, secured to the mount frame 20 next to the last projection 36. By acting as a reference in the arrangement direction of the blocks 30, the positioning member 53 is designed to position the blocks 30.

In the above construction, by accommodating the wire-connected terminal TW in the recesses (guide groove 34, recess 37) of the block 30 and positioning the terminal portion T with respect to the clamps 51, 52 of the inserting unit 50 along the longitudinal direction (vertical direction in FIG. 2) by the pin 38 and along the forward and backward directions by the positioning surfaces 38, 39, the terminal portion T of the wire-connected terminal TW can be detachably accommodated while being exposed such that it can be gripped by the respective clamps 51, 52 of the inserting unit 50. As a result, in the transferring step of transferring the wire-connected terminal TW to the clamps 51, 52 of the inserting unit 50, the wire-connected terminal TW can be remarkably accurately gripped by the clamps 51, 52 so that the succeeding step can be securely performed.

Particularly, since the members for directly positioning the terminal T (pin 38, positioning surfaces 38A, 39) are adopted as the positioning means in the above construction, the wire-connected terminal TW can be accurately positioned along the vertical direction. As a result, there is an advantage that the wire-connected terminal TW can be more securely transferred to the clamps 51, 52.

Further, in the above construction, by selecting the blocks according to the kinds of the wire-connected terminals TW to be retained and arranging them side by side on the mount frame 20, a desired combination of desired wire-connected terminals TW can be retained and arranged side by side. Accordingly, even in the case of producing different kinds of wire-connected terminals TW in small quantity, the kinds of the wire-connected terminals TW can be advantageously easily changed by changing the combination of the blocks 30.

Furthermore, in the above construction, since the center axes C of the wire-connected terminals TW are aligned at the specified intervals H regardless of the kinds of wire-connected terminals TW to be retained, a control for the clamps 51, 52 can be simplified. This results in a shorter time to exchange the blocks 30, since the control routine or sequence can be shortened. Thus, a multitude of kinds of wire-connected terminals can be more effectively produced in small quantity.

The foregoing embodiment is nothing but the illustration of a preferred specific example of the invention, and the invention is not limited to the foregoing embodiment.

Figure 6B:
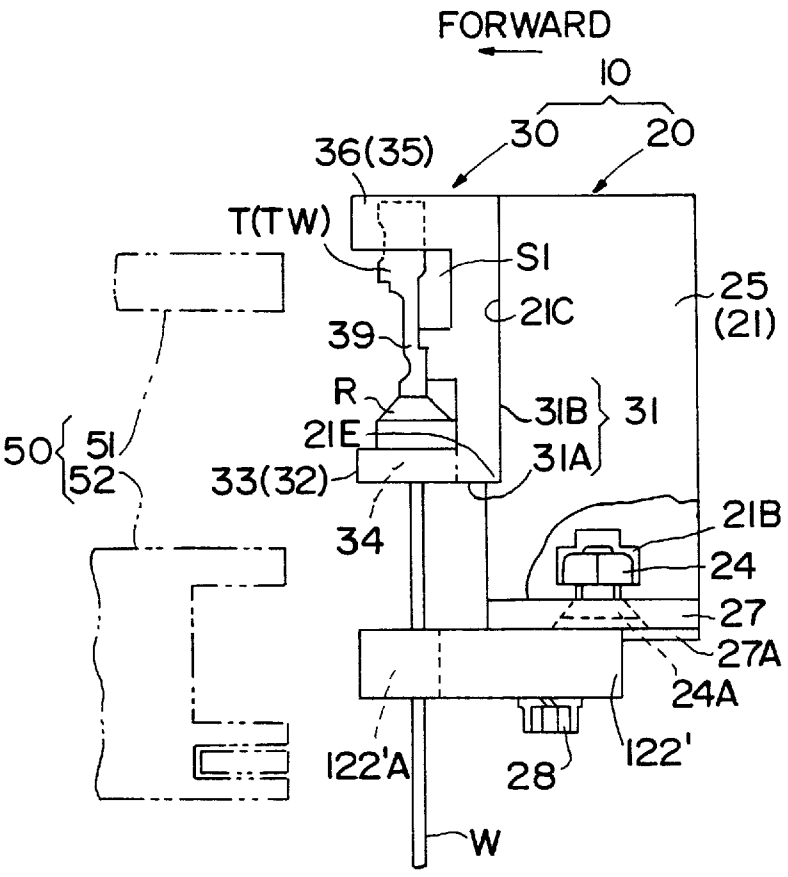
Figure 6A:
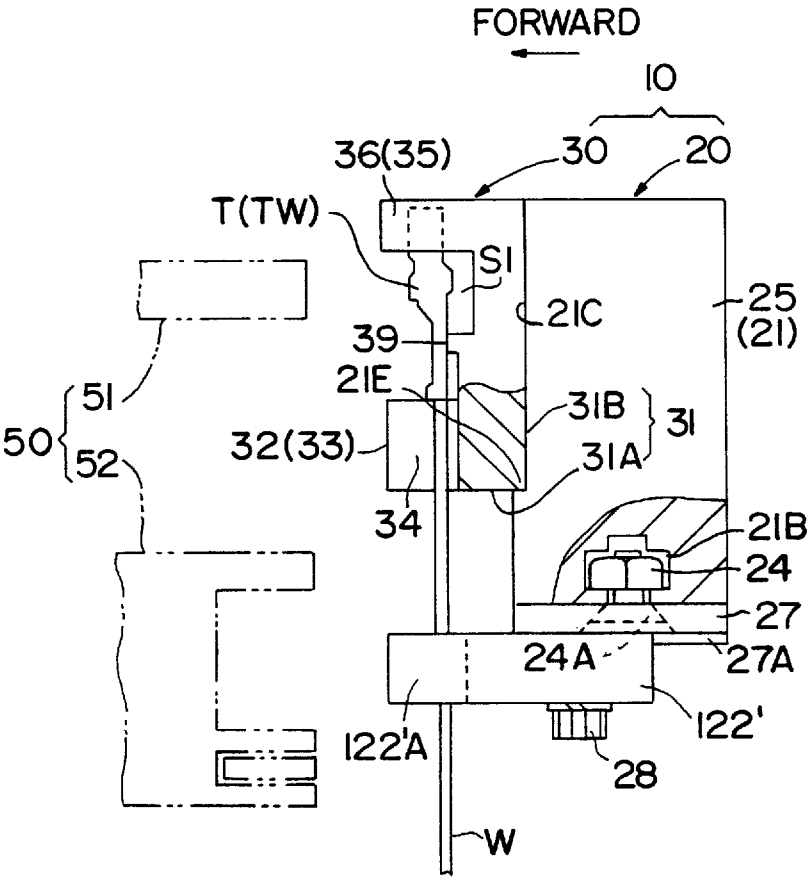
Figure 7:
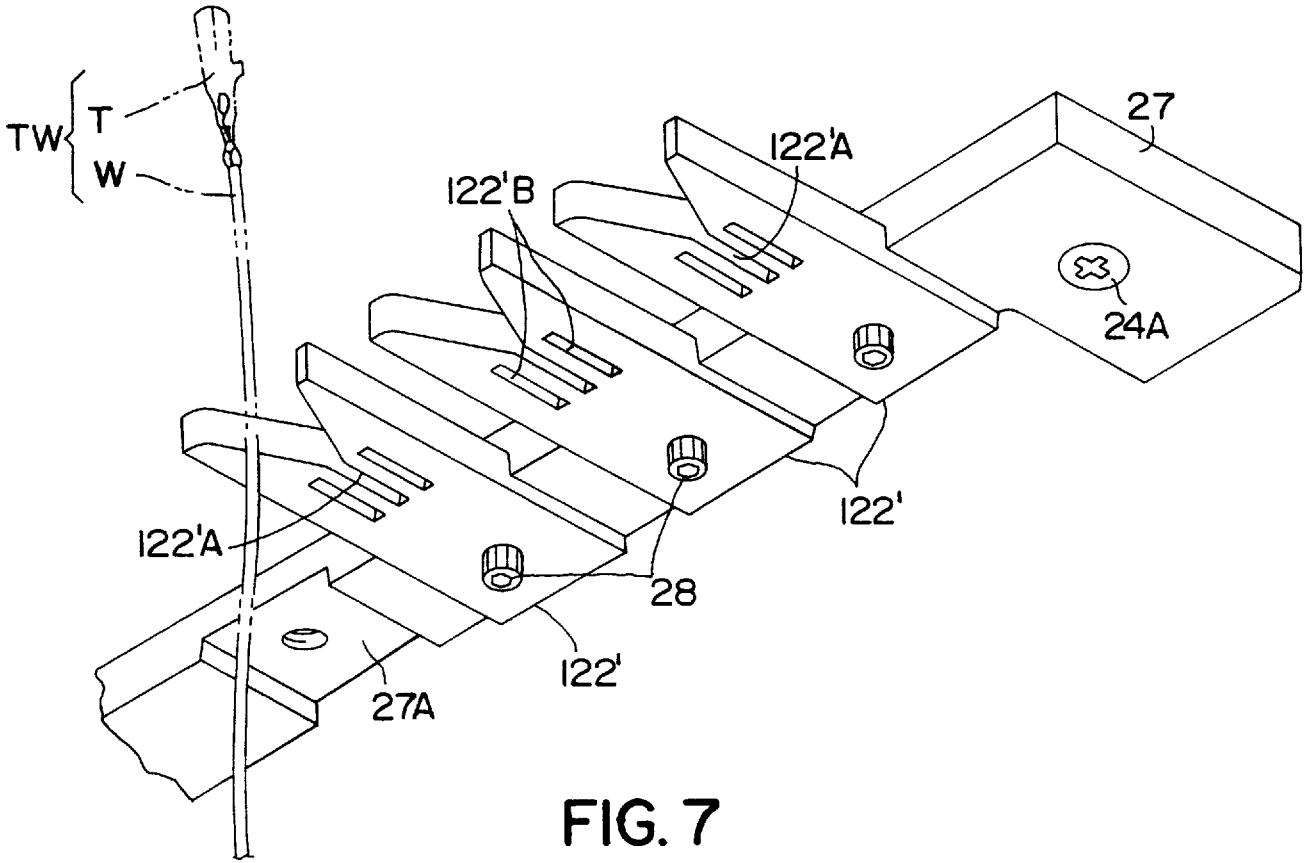
FIG. 7 is a perspective view of an essential portion of the embodiment of FIG. 6.

FIGS. 6A and 6B show another embodiment of the invention, wherein FIG. 6A is a section of this embodiment when a normal wire-connected terminal TW is retained and FIG. 6B is a section thereof when a wire-connected terminal TW having a portion between a terminal portion T and a wire portion W sealed by a rubber plug R is positioned. FIG. 7 is a perspective view of an essential portion of the embodiment of FIGS. 6A and 6B.

As shown in FIGS. 6A and 6B, the positioning means may adopt a method for placing the bottom surface of the terminal portion T (FIG. 6A) or placing the bottom surface of the rubber plug R (FIG. 6B) on the upper surface of the first projections 32, 33. When this construction is adopted, the pin 38 and the ball plunger 40 may be omitted.

Further, as shown in detail in FIG. 7, guide members 122' e.g. in the form of forked pieces separately provided for the respective wire-connected terminals TW may be adopted . The guide members 122' are fitted in positioning grooves 27A formed in the bottom surface of the main body 21 of the mount frame 20 via a mount member 27, and are detachably fastened by bolts 28 formed with hexagonal holes. In the shown example, each guide member 122' is made of resin, and includes a groove 122' A into which the wire portion W of the wire-connected terminal TW is pressed and a pair of holes 122' B for causing a portion of the guide member 122' where the groove 122' A is formed to elastically deform. Each groove 122' A is gradually widened at its leading end so as to facilitate the insertion of the wire portion W. The wire-connected terminal TW is positioned by pressing the wire portion W into the groove 122' A and by retaining the wire portion W such that a tensile force acts between the groove member 122' and the bottom surface of the terminal portion T or rubber plug R.

The mount member 27 is secured by threadedly fitting the bolts 24A to the nuts 24 provided in the main body 21.

It should be appreciated that a variety of design changes are possible within the scope of the invention as defined in claims.

Figure 8:
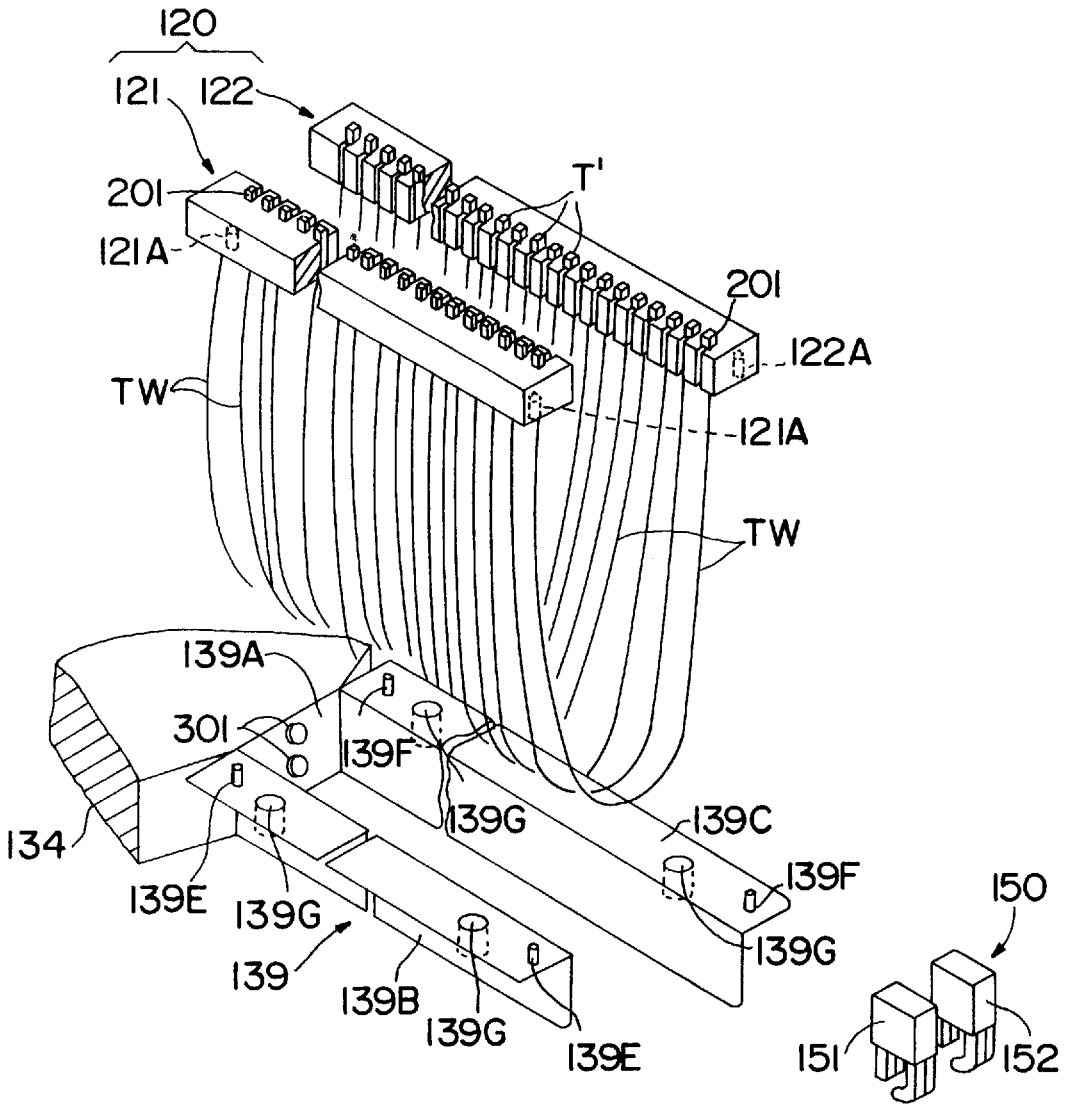
FIG. 8 is an exploded perspective view partly in section of a retainer according to one further embodiment of the invention and a mount arm.

FIG. 8 is an exploded perspective view partly in section of a retainer 120 for terminal-connected wires or wire-connected terminals according to one further embodiment of the invention and a mount arm 139. The retainer 120 is detachably secured, via the mount arm 139, to a conveyance disk 134 for conveying terminal-connected wires TW to insertion hands or grippers or clamps 151, 152 of an inserting unit 150.

The mount arm 139 is an angle member including a fixed portion 139A secured to the disk 134 by bolts 301 substantially along a tangential direction of the disk 134, a first arm 139B extending from one end of the fixed portion 139A along a radial direction substantially normal to the fixed portion 139A, and a second arm 139C extending from the other end of the fixed portion 139A substantially in parallel with the first arm 139B. The fixed portion 139A, first arm 139B and second arm 139C are in particular integrally or unitarily formed. A plurality of mount arms 139 are secured to the periphery of the disk 134 at specified intervals along the same circumferential direction.

The retainer 120 includes a first block 121 mounted on the first arm 139B and a second block 122 mounted on the second arm 139C, and is adapted to retain the terminal-connected wires TW. Each terminal-connected wire TW has a terminal T' at its one end accommodated in a corresponding recess 201 formed in the first block 121 and has a terminal T' at its other end accommodated in a corresponding recess 201 formed in the second block 122, with the result that it hangs down in a U-shape between the blocks 121 and 122.

The respective blocks 121, 122 have bottomed engaging holes 121A, 122A formed in their lower surfaces. On the arms 139B, 139C, positioning pins 139E, 139F corresponding to the engaging holes 121A, 122A of the corresponding blocks 121, 122 stand upright. By fitting the pins 139E, 139F into the engaging holes 121A, 122A of the respective blocks 121, 122, the blocks 121, 122 can be positioned with respect to the respective arms 139B, 139C. Further, securing members 139G are mounted on the respective arms 139B, 139C to detachably connect the blocks 121, 122 and the arms 139B, 139C. Screws may be adopted as securing members 139G, or permanent magnets may also be adopted in the case that the blocks 121, 122 are made of magnetic material.

Figure 9:
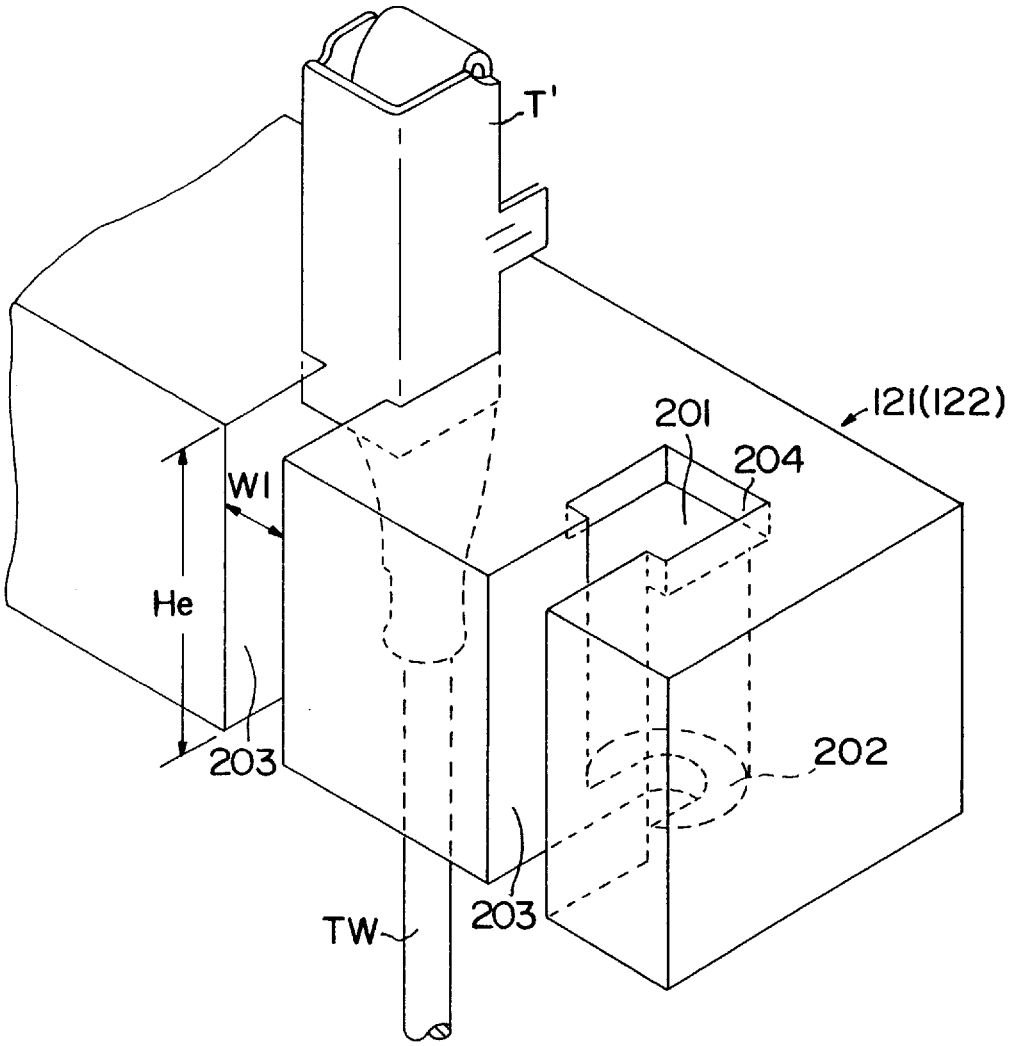
FIG. 9 is a perspective view enlargedly showing an essential portion of a block.

FIG. 9 is a perspective view enlargedly showing an essential portion of the blocks 121, 122. The blocks 121, 122 each include recesses 201 for unrotatably accommodating the terminals T' of the terminal-connected wires TW while being opened such that the leading ends of the terminals T' are retained, positioning surfaces 202 which are continuous with the corresponding recesses 201 and are adapted to position the bottom surfaces of the terminals T' accommodated in the recesses 201, and slits 203 for permitting the insertion and withdrawal of the terminals T' into and from the recesses 201 by permitting the terminal-connected wires TW to pass therethrough.

Each recess 201 defines a rotation prevention surface 204 for preventing the rotation of the terminal T'. In the example of FIG. 9, the rotation prevention surface 204 is realized by forming the upper part of the recess 201 so as to have a substantially rectangular contour in conformity with the outer shape of the terminal T'.

The slits 203 have a width W1 at least necessary and sufficient for the insertion of the terminal-connected wires TW, and extend over the entire height He of the blocks 121, 122. Thus, an operator grips the terminal T' of the terminal-connected wire TW, inserts the wire TW through the slit 203, and then lowers the terminal T', causing its bottom surface to be seated on the positioning surface 202. In this way, the terminal T' can be retained in the recess 201. Since the recesses 201 unrotatably accommodate the terminals T' of the wires TW by the rotation prevention surfaces 204 and position the bottom surface of the terminal T' by the positioning surfaces 202, the terminals T' can be securely retained in the same position.

The rotation prevention surfaces 204 may be realized by members different from the blocks 121, 122. In such a case, the configuration of the blocks 121, 122 can be simplified.

Figure 10:
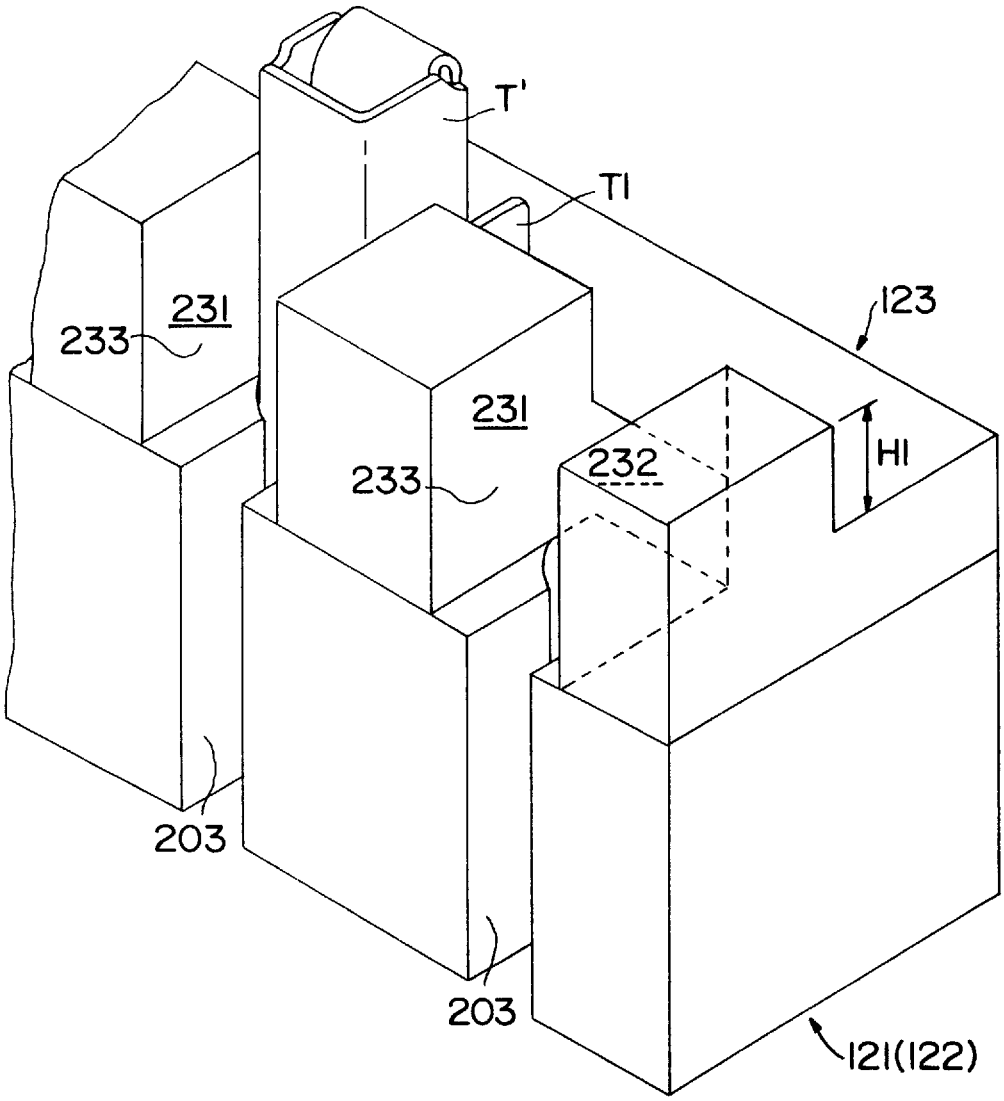
FIG. 10 is a perspective view of another embodiment of the invention.

FIG. 10 is a perspective view of another embodiment of the invention. Rotation prevention is realized in this embodiment by pieces 123 on the upper surfaces of the blocks 121, 122. In particular rotation prevention is achieved by a pair of side surfaces 231, 232 for holding the terminal T' from opposite sides, and the piece 123 is formed with openings 233 for exposing the front surfaces of the terminals T'. In this construction, since the rotation of the terminal fitting is prevented by holding the terminal T' by the pair of side surfaces 231, 232 exposing the front surface of the terminal T', the shape of the rotation prevention surface can be simplified. In the example of FIG. 10, the piece 123 is stepped by height H1 in order to avoid the interference of the terminal T' with a stabilizer T1.

Figure 11:
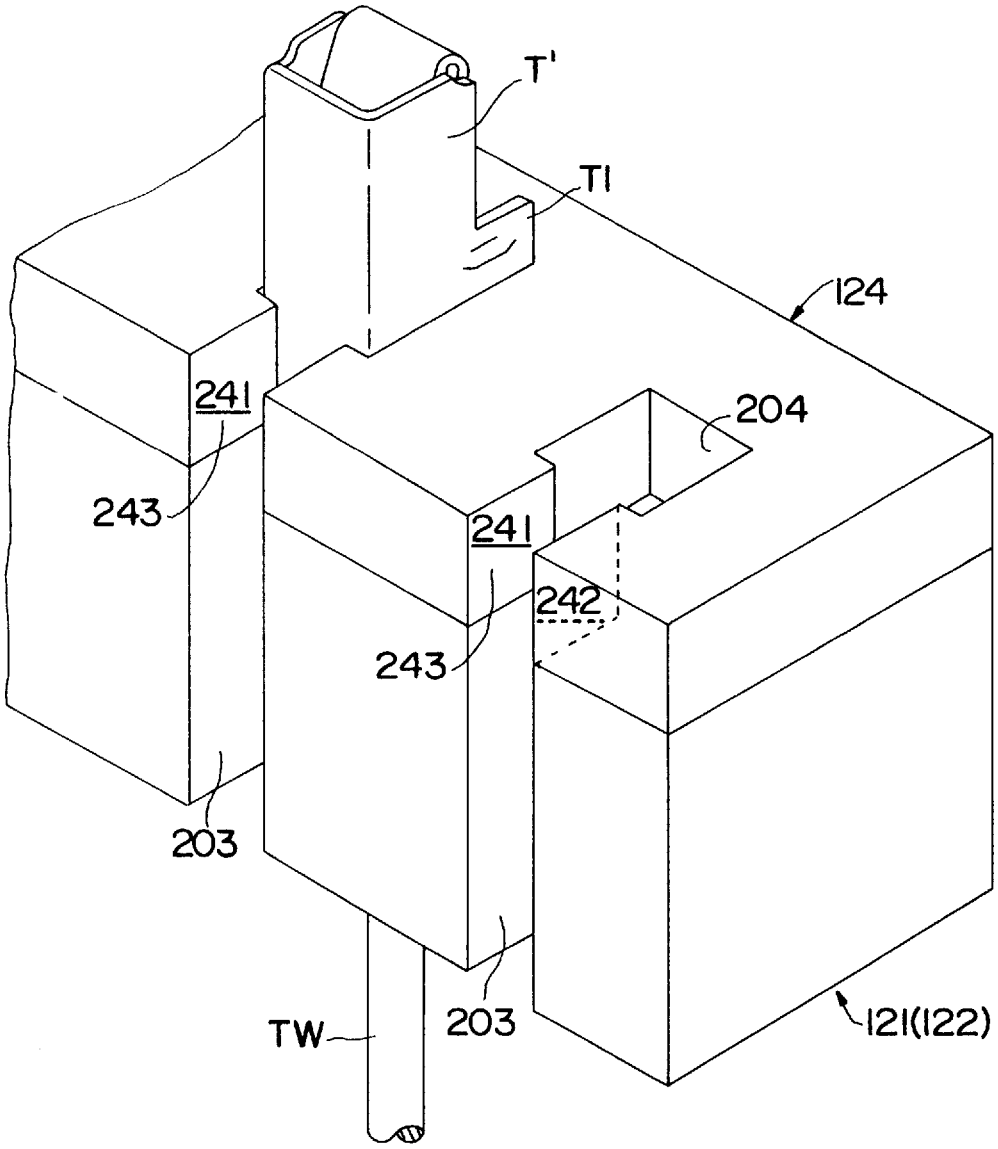
FIG. 11 is a perspective view of still another embodiment of the invention.

FIG. 11 is a perspective view of still another embodiment of the invention. In the construction of FIG. 11, a piece 124 as a member different from the blocks 121, 122 is formed with the rotation prevention surfaces 204 each including a pair of side surfaces 241, 242 for holding the terminal fittings from opposite sides, and insertion openings 243 which substantially expose the front surfaces of the accommodated terminals T' and communicate with the slits 203. The insertion openings 243 have a width necessary and sufficient to permit the insertion of a wire section adjacent to the connector T' or of the terminal-connected wires or wire-connected terminal TW. In this construction, the terminals T' are held between the pairs of side surfaces 241, 242 exposing the front surfaces of the terminals T', and the rotation of the terminals T' is prevented by portions of the piece 124 where the insertion openings 243 are formed.

When the terminal-connected wires TW are mounted, the blocks 121, 122 already carrying the terminal-connected wires TW are mounted on the respective arms 139B, 139C manually or using a conveyance robot (not shown). By intermittently rotating the disk 134 by a specified or predetermined or predeterminable angle, the terminal-connected wires TW can be conveyed to the succeeding unit.

As described above, in the aforementioned construction, the terminals T' of the terminal-connected wires TW can be securely and uniformly positioned even by manual operation, and the positioned terminals T' can be gripped and taken out by the insertion clamps 151, 152. Accordingly, even in the case that the producing process and the terminal inserting process are performed at separate production lines, the terminals T' of the terminal-connected wires TW can be easily transferred to the insertion clamps 151, 152 while being positioned, thereby making the automation easily realizable.

In the case that the pieces 123 or 124 are adopted, the configuration of the blocks 121, 122 can be simplified. Accordingly, the production cost of the blocks 121, 122 can be advantageously reduced.

Further, in the case that the construction of FIG. 10 is adopted, the shape of the rotation prevention surfaces 204 can be simplified. Accordingly, the production cost of the blocks 121, 122 can be advantageously reduced.

On the other hand, in the case that the construction of FIG. 11 is adopted, the terminals T' are held by pairs of side surfaces 241, 242, and the rotation of the terminals T' can be prevented by the portions of the piece 124 where the insertion openings 243 are formed. Thus, the terminals T' can be positioned with an improved precision.

The foregoing embodiments are nothing but preferred specific examples of the invention, and the invention is not limited to these embodiments.

Figure 12:
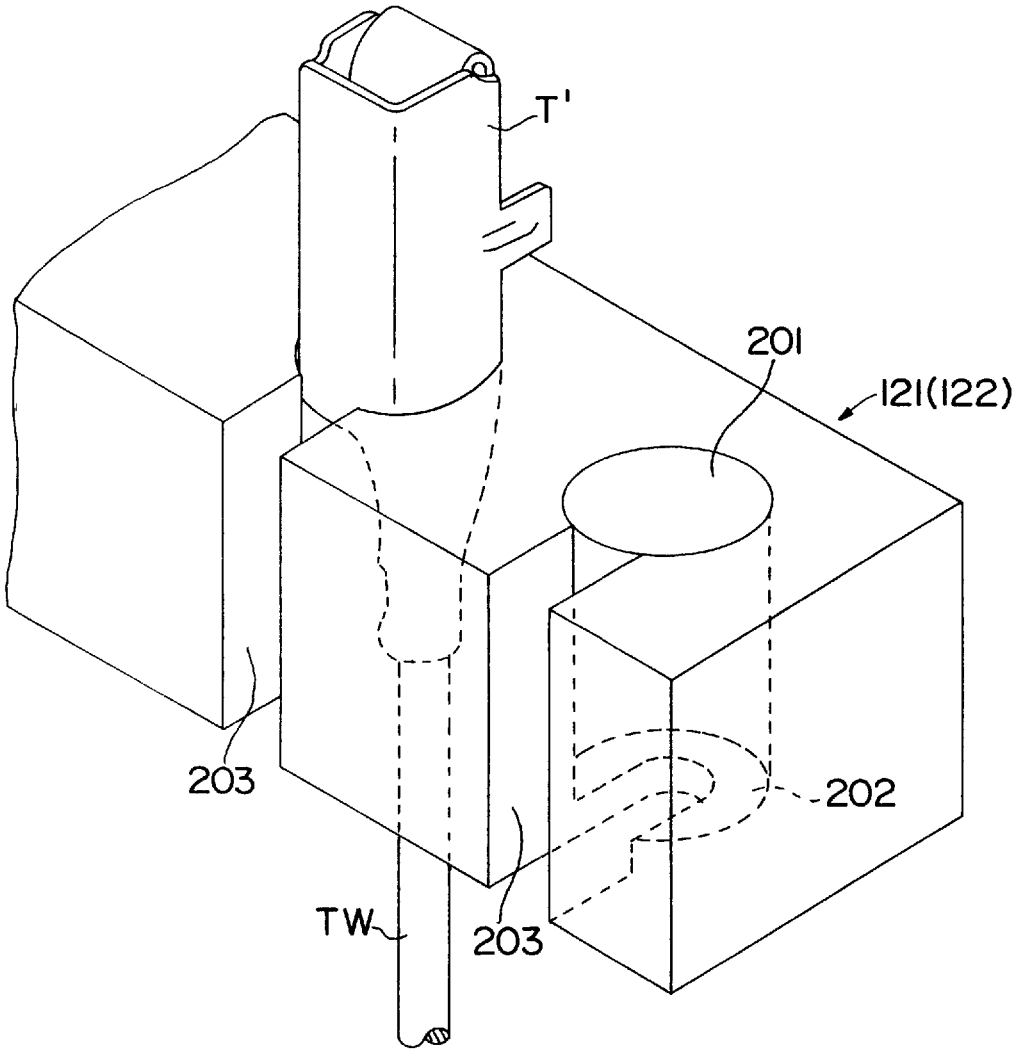
FIG. 12 is a perspective view of further another embodiment of the invention.

For example, a construction of FIG. 12 may be adopted as a block for supplying terminal-connected wires to be transferred to the insertion clamps of the wire-connection process line. In an embodiment of FIG. 11, the rotation prevention surfaces 204 are deleted. With this embodiment, the terminal-connected wires TW can be manually gripped and transferred to the insertion clamp 151, 152 (see FIG. 8).

It should be appreciated that a variety of design changes are possible within the scope of the invention as defined in claims.

What is claimed is:

1. A block for retaining a wire-connected terminal, said wire-connected terminal comprising a wire portion and a terminal portion connected with the wire portion such that longitudinal axes of the terminal portion and the wire portion extend substantially in a common direction, the terminal portion defining at least one width measured transverse to the longitudinal axis thereof and having a rear surface formed with an engagement structure at a specified location, said block comprising:

a positioning surface configured for engaging the rear surface of the terminal portion, a first pair of projections extending from the positioning surface and being spaced from one another bv a distance corresponding to the width of the terminal portion, a second pair of projections extending from the positioning surface, the second pair of projections being spaced from the first pair of projections and being spaced from one another by a distance corresponding to the width of the wire portion, said positioning surface and said first pair and second pair of projections defining a recess for detachably accommodating at least the terminal portion of the wire-connected terminal, and positioning means on the positioning surface for engaging a positioning structure of the terminal portion and positioning the terminal portion longitudinally in the recess, the wire-connected terminal positioned in the recess can be gripped by a clamping means of a terminal inserting unit at a specified position on the wire-connected terminal between the first pair of projections and the second pair of projections of the block.

2. A block according to claim 1, further comprising a slit for receiving the wire portion when the terminal portion is accommodated in the recess.

3. A block according to claim 1, wherein the engagement structure of the terminal portion includes an engaging hole extending into the rear surface, and wherein the positioning means comprises a pin insertable into the engaging hole of the terminal portion.

4. A block according to claim 3, wherein the projections defining the recess are configured for restricting the terminal portion of the accommodated wire-connected terminal from rotating about its longitudinal axis.

5. A block according to claim 4, wherein the rotation restricting surface is defined by a piece formed by a member separate from the block.

6. A block according to claim 5, wherein the rotation restricting surface comprises a pair of side surfaces for holding the terminal portion from substantially opposite sides.

7. A block according to claim 6, wherein the piece defines an aperture for substantially exposing a front surface of the terminal portion.

8. A block according to claim 7, wherein the piece defines at least one insertion opening for permitting insertion of the wire portion.

9. A block according to claim 1, wherein the positioning surface comprises a plurality of positioning means, and wherein the block further comprises a plurality of pairs of first projections and a plurality of pairs of second projections disposed relative to the positioning means for defining a plurality of recesses for retaining a plurality of the wire-connected terminals.

10. A block according to claim 1, wherein the wire-connected terminal further comprises a rubber plug extending between the terminal portion and the wire portion particularly comprises a pin (38) insertable into an engaging hole, and wherein the second pair of projections comprises a positioning surface for positioning a bottom surface of the rubber plug connected to the terminal portion and the wire portion.

11. A block according to claim 1, further comprising retention means for resiliently and releasably retaining the terminal portion in the recess.

12. A block according to claim 11, wherein the retention means comprises a resilient detent in at least one of said projections for releasably retaining the wire-connected terminal in the recess.

13. A block according to claim 12, wherein at least one of said projections of said block includes a hole formed therein, and wherein said resilient detent comprises a ball moveable into a position for projecting partly from said hole and a coil spring for urging said ball into the position for projecting partly from said hole, said ball releasably retains said wire-connected terminal in said recess.

* * * * *